US010493786B2

(12) United States Patent
Peleman

(10) Patent No.: US 10,493,786 B2
(45) Date of Patent: Dec. 3, 2019

(54) METHOD FOR BINDING A BUNDLE OF LEAVES AND A BOOK OR FOLDER THEREBY OBTAINED

(71) Applicant: UNIBIND LIMITED, Nicosia (CY)

(72) Inventor: Guido Frans M. Peleman, Knokke-Heist (BE)

(73) Assignee: UNIBIND LIMITED, Nicosia (CY)

( * ) Notice: Subject to any disclaimer, the term of this patent is extended or adjusted under 35 U.S.C. 154(b) by 0 days.

(21) Appl. No.: 16/065,948

(22) PCT Filed: Jan. 17, 2017

(86) PCT No.: PCT/IB2017/000016
§ 371 (c)(1),
(2) Date: Jun. 25, 2018

(87) PCT Pub. No.: WO2017/125808
PCT Pub. Date: Jul. 27, 2017

(65) Prior Publication Data

US 2018/0370271 A1 Dec. 27, 2018

(30) Foreign Application Priority Data

Jan. 20, 2016 (BE) ..... 2016/5039

(51) Int. Cl.
*B42C 5/00* (2006.01)
*B42C 5/06* (2006.01)
(Continued)

(52) U.S. Cl.
CPC ..... *B42C 5/00* (2013.01); *B42C 5/06* (2013.01); *B42C 19/02* (2013.01); *B42D 1/006* (2013.01)

(58) Field of Classification Search
CPC ..... B42D 1/006; B42F 1/08; B42C 19/02; B42C 5/00; B42C 5/06
(Continued)

(56) References Cited

U.S. PATENT DOCUMENTS 696,281 A * 3/1902 Toole ..... B42D 1/003 281/41
1,913,320 A * 6/1933 Woodward ..... B42D 5/021 281/40
(Continued)

FOREIGN PATENT DOCUMENTS

BE 2013/0014 1/2013
EP 0 153 851 9/1985
(Continued)

OTHER PUBLICATIONS

International Search Report, PCT/IB2017/000016, dated Apr. 4, 2017.
Written Opinion, PCT/IB2017/000016, dated Apr. 4, 2017.

*Primary Examiner* — Kyle R Grabowski
(74) *Attorney, Agent, or Firm* — Young & Thompson

(57) ABSTRACT

A method for binding a bundle (6) of leaves (1), where an edge (3) of the bundle (5) of leaves (1) is bound, and for the binding, use is made of a bundle (6) of leaves (1) in which the leaves (1) present a first fold line (2) that extends parallel to and at a distance (A) from the edge (3), and where the leaves (1) also present a second fold line (4) that is located parallel to and at a distance (B) from the first fold line (2), and which is located between the edge (3) and the first fold line (2).

13 Claims, 5 Drawing Sheets

(51) Int. Cl.
*B42D 1/00* (2006.01)
*B42C 19/02* (2006.01)

(58) Field of Classification Search
USPC ..... 281/40, 38
See application file for complete search history.

(56) References Cited

U.S. PATENT DOCUMENTS

| | | | | | |
|---|---|---|---|---|---|
| 1,962,407 | A * | 6/1934 | Pierce | B42C 5/00 | 281/40 |
| 2,304,918 | A * | 12/1942 | Hofrichter | B42D 1/06 | 281/40 |
| 2007/0203008 | A1 | 8/2007 | Parker et al. | | |
| 2012/0169036 | A1 * | 7/2012 | Huotari | B42D 13/00 | 281/40 |
| 2015/0283843 | A1 * | 10/2015 | Peleman | B42D 1/006 | 428/68 |

FOREIGN PATENT DOCUMENTS

| | | | | |
|---|---|---|---|---|
| EP | 0153851 | A2 * | 9/1985 | B42C 5/00 |
| EP | 2 295 261 | | 3/2011 | |
| FR | 704 453 | | 5/1931 | |
| WO | WO 2014/072778 | | 5/2014 | |
| WO | WO-2014072778 | A1 * | 5/2014 | B42D 1/006 |

* cited by examiner

METHOD FOR BINDING A BUNDLE OF LEAVES AND A BOOK OR FOLDER THEREBY OBTAINED

BACKGROUND OF THE INVENTION

Field of the Invention

The present invention relates to a method for binding a bundle of leaves, for example to form a book or similar, in particular to obtain a book or folder whose leaves can be opened flat and the printing runs seamlessly across the two open leaves.

This last aspect is particularly desired for composing books of photographs, magazines and similar with photographs and illustrations that run across the entire width of the open book.

Description of the Related Art

Traditionally a number of different methods are known for composing books.

A method is known for example whereby books are put together from a bundle of single leaves, not folded in half, by gluing one edge of the bundle of single leaves.

In order to make this bond strong, so that no leaves come loose when opening and closing the book, the bundle of leaves will always be in the adhesive over a limited distance, for example half a millimetre, so that the adhesive also gets in between the leaves of the bundle.

The current adhesives are very flexible and enable the book to be opened completely flat after gluing, without the leaves coming loose.

However, by completely opening the book, the adhesive that gets between the leaves during gluing is clearly visible.

This visible adhesive is annoying when the printing of the leaves continues up to the binding. Indeed, this adhesive will get over the printing and will reduce the aesthetic appearance of the printing there.

Leaves are also known with an integrated, laminated and printable hinge, that enable a bundle of these leaves to be bound in order to form a book or similar, whereby the leaves are flat after opening the bundle.

However, the production of such leaves is an expensive process and the processing is labour intensive.

A method as described in BE 2012/0759 and BE 2013/0014 is already known, whereby an edge of the bundle of the leaves of paper is introduced into the binding spine and fastened therein, whereby for the binding use is made of a bundle of leaves where a strip of each leaf is double folded separately beforehand along the same line to form a fold line that extends parallel to and at a distance from said edge.

Double folded here means that the strip is first folded in the one direction and then folded in the other direction.

An advantage of such a method is that the fold line enables the leaves to be folded along this fold line when the book is opened and that when the bundle of leaves is bound in the spine, the leaves lie with their sharp fold lines against one another, so that the printing can continue across opened leaves across two adjacent fold lines as good as seamlessly.

Another advantage is that when the bundle is opened there is no gap between the opened leaves, so that the adhesive, stitching or staples that are used to bind the bundle in the spine are not visible and thus do not interfere with the printing that continues from the one leaf to the other leaf.

However, practice has shown that the opened leaves do not extend completely flat, but present a (slight) bulge close to the fold line.

This bulge is particularly annoying when the print or photograph extends over two opened leaves, which can make the printing less visible close to the fold lines.

BRIEF SUMMARY OF THE INVENTION

The purpose of the present invention is to provide a solution to at least one of the aforementioned and other disadvantages.

The present invention concerns a method for binding a bundle of leaves, whereby an edge of the bundle of leaves is bound, whereby for the binding use is made of a bundle of leaves in which the leaves present a first fold line that extends parallel to and at a distance from said edge, whereby the leaves also present a second fold line that is located parallel to and at a distance from said first fold line, and which is between said edge and the first fold line.

An advantage is that by using the double parallel fold lines, the leaves will extend completely flat when the bundle is opened.

This occurs because there are two fold lines so that the leaves can fold in two places. As a result the bulging of the leaves when the bundle is opened can be prevented.

Another advantage is that, with the application of two fold lines, when the bound bundle is opened the second fold lines lie against one another so that the print over the two adjacent fold lines can continue as good as seamlessly over the opened leaves.

There will be no gap between the opened leaves, so that the adhesive, stitching or the staples with which the bundle of leaves is bound are not visible.

Another advantage is that the method according to the invention is very cheap to implement and there is no need for example for expensive leaves with an integrated, laminated and printable hinge.

In a practical embodiment the first and second can be obtained by the prior separate double folding along the same line in order to form the fold line concerned.

This has the advantage that a sharp fold line can be obtained along which the leaf can easily be folded open in both directions.

Preferably the distance between the first and second fold line is two to three millimetres.

Such a distance between the two fold lines will ensure the best result in most cases.

It is clear that this distance can also be larger or smaller if very thick leaves are used for example or if a very large number of leaves are incorporated in the bundle.

According to a preferred characteristic of the invention, for the binding use is made of a binding spine that is preferably a U-shaped or V-shaped binding spine and that the distance between said edge and the second fold line essentially corresponds to the depth of the binding spine or is somewhat larger than the depth of the binding spine.

This has the advantage that at the level of the second fold line the leaves can be folded back over the binding spine when the bundle is fastened in the binding spine.

In a preferred embodiment the sides of the adjacent leaves oriented towards one another are first provided with printing that runs across the second fold line of both leaves seamlessly as it were, from one side to the other side to which the part of the printing on one side is applied up to the second fold line of the leaf concerned and the part of the printing of the other side is applied up to the second fold line of the adjacent leaf.

An advantage of this is that the printing, for example a photograph, can run over two sides of adjacent leaves. Moreover, the printing does not have to continue up to said edge, such that the printing of the leaves is easier.

The invention also concerns a bundle of leaves, whereby the leaves present a first fold line that extends parallel to and at a distance from an edge of the leaves, whereby the leaves also present a second fold line that is located parallel to and at a distance from said first fold line and which is between said edge and the first fold line.

The invention also concerns a book or folder with a binding spine and a bundle of leaves bound therein, whereby the bundle is a bundle according to the invention.

BRIEF DESCRIPTION OF THE DRAWINGS

With the intention of better showing the characteristics of the invention, a few preferred variants of a method according to the invention for binding a bundle of leaves and a book or folder thereby obtained, are described hereinafter by way of an example, without any limiting nature, with reference to the accompanying drawings, wherein:

FIGS. 7 to 9 show the book or folder of FIG. 6 while browsing through;

DETAILED DESCRIPTION OF THE PREFERRED EMBODIMENTS

Figure 1:
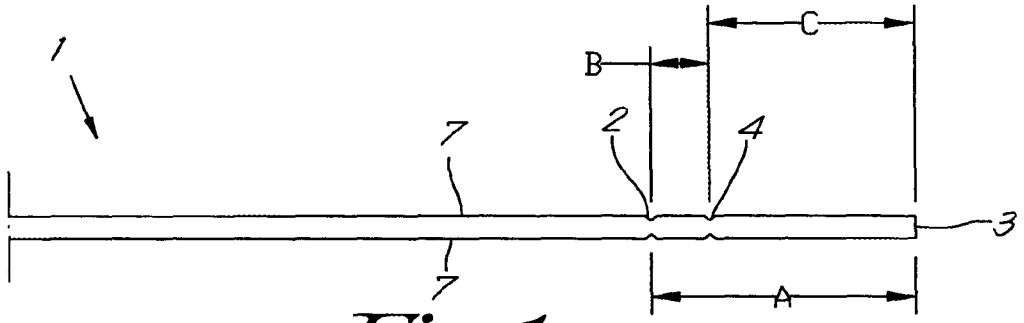
FIG. 1 schematically shows a leaf of a bundle of leaves according to the invention.

FIG. 1 schematically shows a leaf 1 of a bundle of leaves 1 according to the invention that is used in a method for binding a bundle of leaves 1 according to the invention.

The leaf 1 presents a first fold line 2 that extends parallel to and at a distance A from an edge 3 of the leaf 1.

This edge 3 is the edge 3 with which the leaf 1 will be bound.

The leaf 1 also presents a second fold line 4 that is located parallel to and at a distance B from said first fold line 2.

The second fold line 4 is between said edge 3 and the first fold line 2. The distance C between the second fold line 4 and said edge 3 is thus A-B.

The distance B between the first fold line 2 and the second fold line 4 is preferably between one to four millimetres and even better between two to three millimetres.

The first and second fold lines 2, 4 can be realised in different ways.

Figure 2:
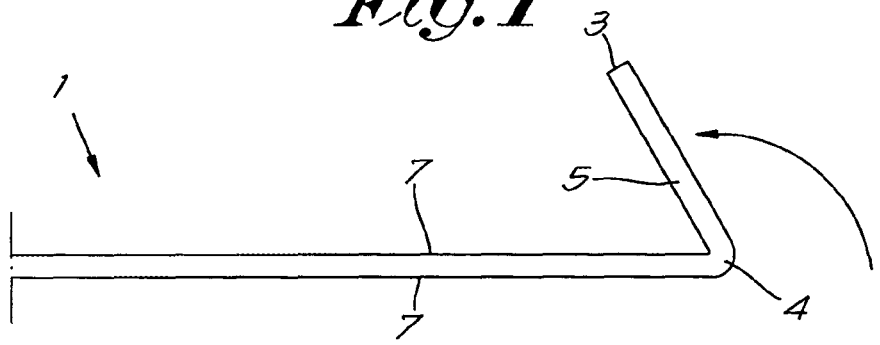
FIGS. 2 and 3 show a possible method for manufacturing the leaf of FIG. 1.
Figure 3:
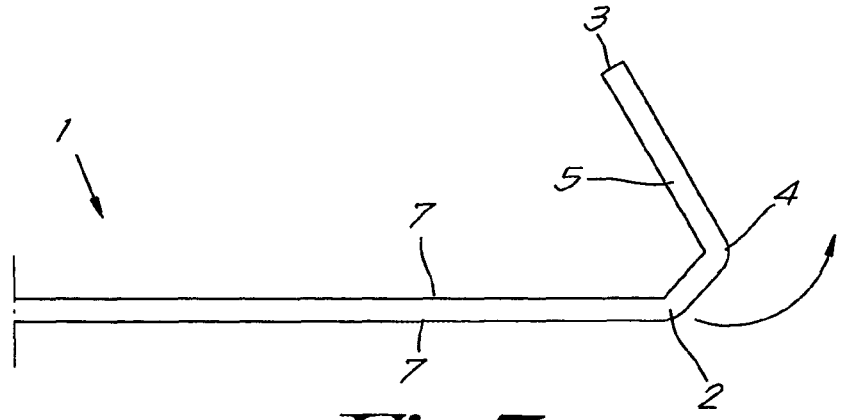

FIGS. 2 and 3 show a possible variant. As shown in these drawings, the first and second fold lines 2, 4 are obtained by the prior separate folding over of a strip 5 of the leaves 1 along a line to form the fold lines 2, 4 concerned.

As a result the strip 5 of the leaf 1 is preferably folded over an angle of at least 90° and even better over an angle of at least 120°.

In this case the leaf 1 is only folded over once each time along the line concerned.

It is also possible that the leaf 1 is folded over double or twice along the line concerned, whereby the strip 5 is folded over once in the one direction and once in the other direction. In this way a sharper fold line 2, 4 can be obtained.

It is not excluded either that the second fold line 4 is created by the double folding over of the leaf 1 along the line concerned and that the first fold line 2 is created by folding it over once along the line concerned, as shown in FIG. 2.

After folding the leaves 1 to form the first and second fold line 2, 4, the strip 5 of the leaf 1 is folded back to the plane of the leaf 1, so that a leaf 1 as shown in FIG. 1 is obtained.

Instead of folding the leaf 1 once or twice, it is also possible that the first and/or second fold line 2, 4 is obtained by scoring the leaves 1 of the bundle along a line to form the fold line 2, 4 concerned.

Figure 4:
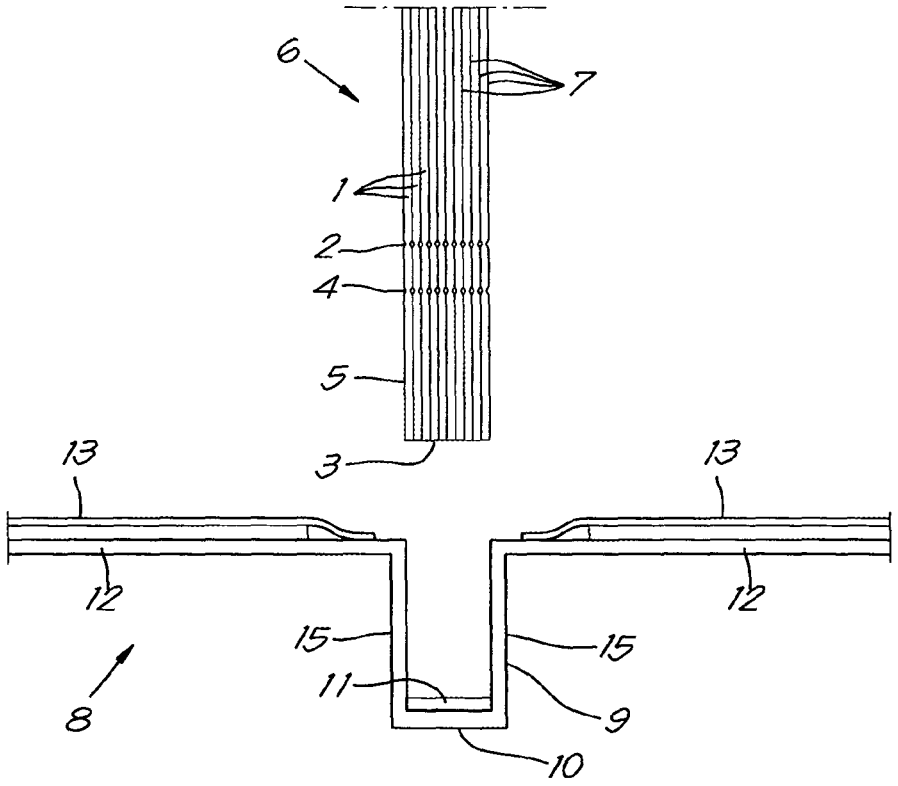
FIG. 4 schematically shows a bundle of leaves according to the invention, ready to be bound in a binding spine.

After the leaves 1 have been folded according to the steps shown in FIGS. 2 and 3, a bundle 6 of leaves 1 is formed as shown in FIG. 4.

As can be seen in FIG. 4, the bundle 6 consists of a number of leaves 1 that are placed with their sides 7 against one another, whereby the edges 3 of the leaves 1 to be bound are aligned with respect to one another.

As can be seen in this drawing, the distance B between the first and second fold line 2, 4 is the same for all leaves of the bundle 6. This does not necessarily need to be the case.

All leaves 1 of the bundle 6 present the second fold line 4 at the same distance C from said edge 3. This does not necessarily need to be the case either.

The bundle 6 can then be bound, for example in a binding spine 8 as shown in FIG. 4. In this case the binding spine 8 is a U-shaped binding spine 8 that consists of a U-shaped part 9, for example of metal, with a layer of hotmelt adhesive 11 on the base 10.

The binding spine 8 is further provided with two endpapers 12, for example of cardboard that are provided on either side of a covering 13.

It is clear that the binding spine 8 can also take on other forms and can be a V-shaped binding spine 8 for example.

Figure 5:
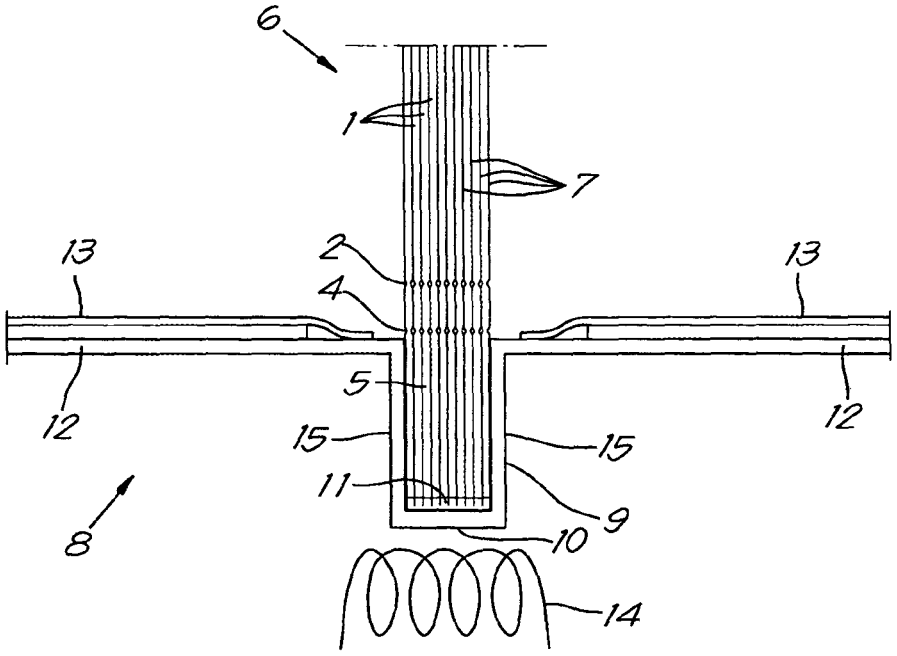
FIG. 5 schematically shows a bundle of leaves according to the invention that is bound in the binding spine.

The bundle 6 is placed in the U-shaped part 9 of the binding spine 8, whereby the edges 3 of the leaves 1 are placed against the layer of hotmelt adhesive 11, as shown in FIG. 5.

Hereby the second fold line 4 of the leaves 1 ends up somewhat above the U-shaped 9 part.

Then the layer of hotmelt adhesive 11 is heated by a heat source 14. The hotmelt adhesive 11 will melt as a result and become liquid, such that the leaves 1 of the bundle 6 can be affixed therein.

After solidification of the hotmelt adhesive 11, the bundle 6 is attached to the binding spine 8 via the hotmelt adhesive 11.

Figure 6:
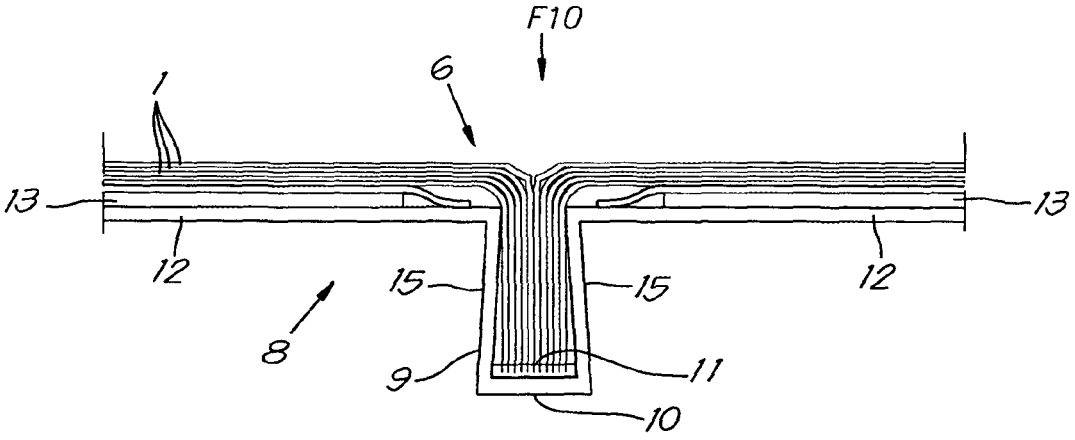
FIG. 6 schematically shows a book or folder according to the invention.

Then, as can be seen in FIG. 6, the arms 15 of the U-shaped part 9 of the binding spine 8 are squeezed towards one another. This will ensure an extra sturdy fastening of the bundle 6 in the binding spine 8 and the connection of the bundle 6 against the free edges of the arms 15 without a gap being visible between the two.

The bound bundle 6 is now finished into a folder with bound leaves 1.

As can be seen in FIG. 6, when opening the bundle the leaves will extend in one plane.

In reality the result is better than shown in the drawings that give a somewhat distorted picture because a certain thickness has been given to the leaves 1 for the purpose of clarity.

Figure 7:
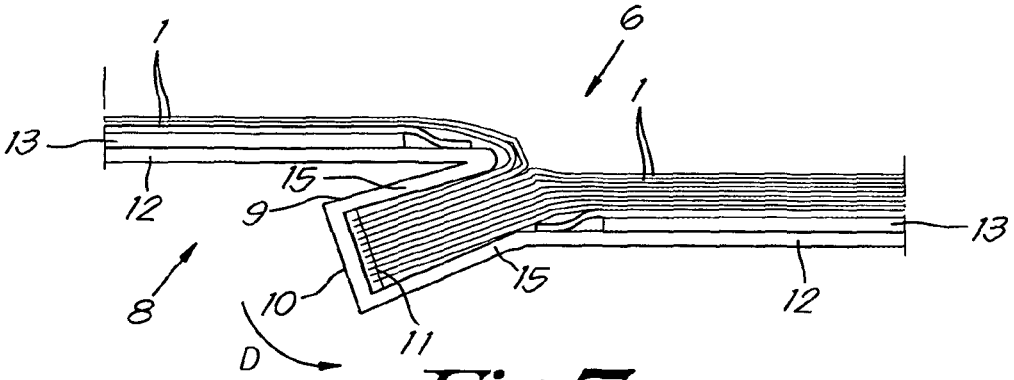
Figure 8:
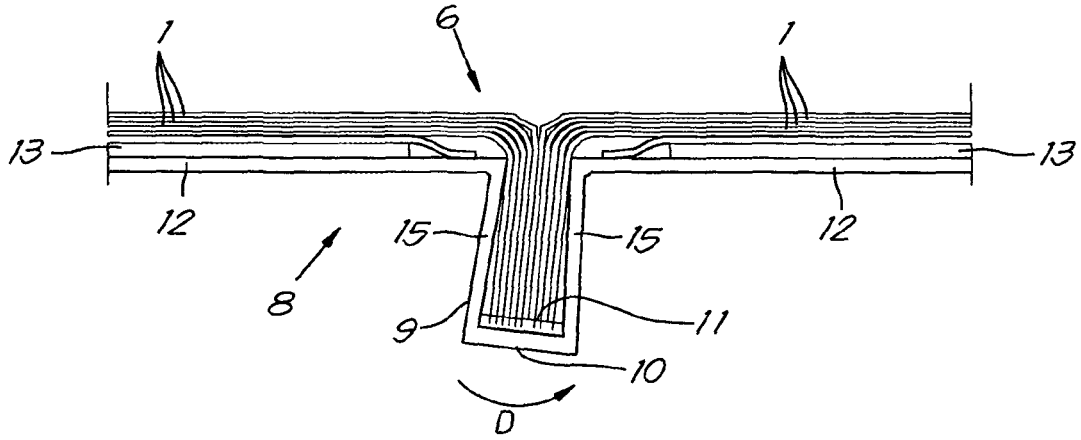
Figure 9:
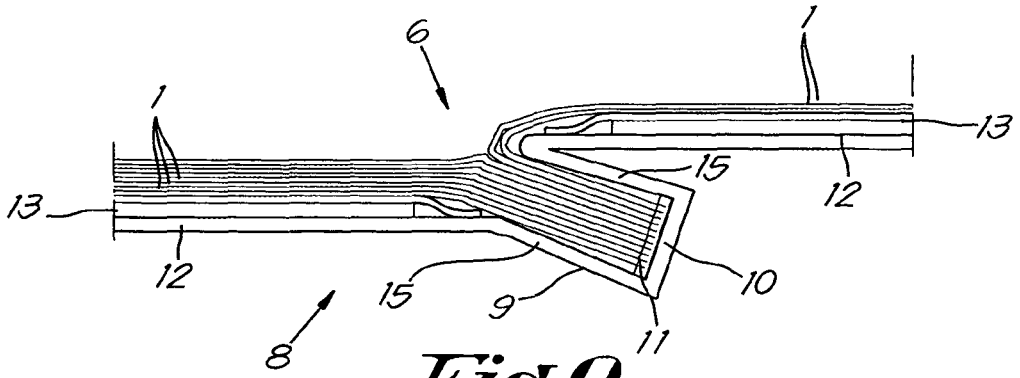

FIGS. 7 to 9 schematically show how the U-shaped part 9 of the binding spine 8 will turn when leafing through.

When an endpaper 12 is opened, it can be folded up to against the arm 15 of the U-shaped part, as can be seen in FIG. 7.

When leafing through further, the arm 15 of the U-shaped part 9 will move away from this endpaper 12 because the U-shaped part 9 will turn according to the arrow D towards the other endpaper 12. This is shown in FIG. 8.

When leafing through even further, as shown in FIG. 9, the U-shaped part 9 of the binding spine 8 will turn further up to the other arm 15 of the binding spine 8 and finally will be against the other endpaper 12.

This turning of the binding spine 8 is done automatically as it were when leafing through the bundle 6 and will ensure that the leaves 1 extend flat when the bundle 6 is opened at a certain page.

Figure 10:
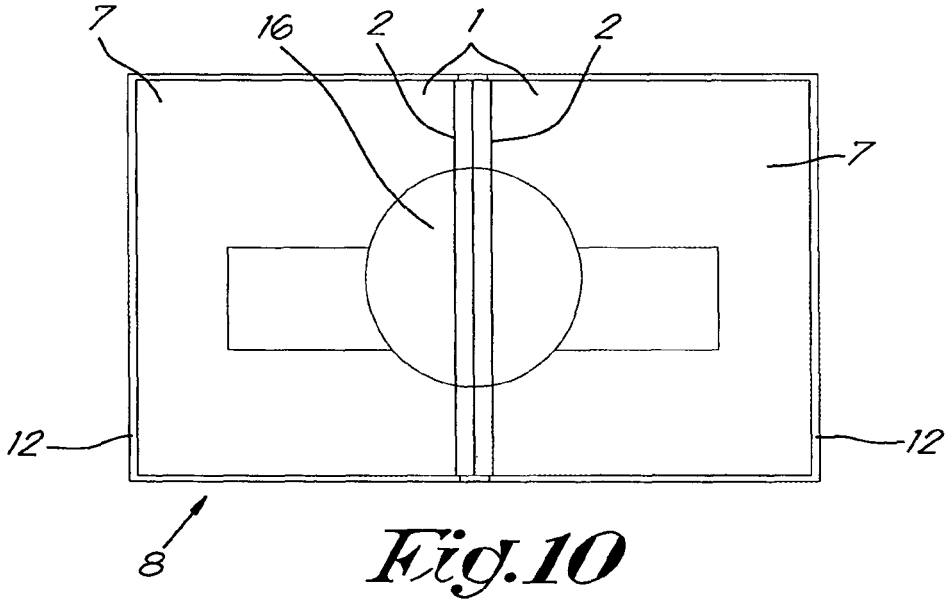
FIG. 10 shows a view according to the arrow F10 of FIG. 6.

As presented in FIG. 10, the leaves 1 are provided with printing 16 beforehand. Hereby the printing 16 continues up to the second fold line 4, whereby the strip 5 remains unprinted.

The sides 7 of the leaves 1 are printed for example with a part of an illustration 16 or photograph, whereby the illustration continues as good as seamlessly from the one leaf 1 to the other leaf 1 over the fold lines 2, 4, to form one continuous illustration in this way. This is useful for example when compiling a photo album, whereby in this way large photographs can be provided that extend over two leaves 1 and this without an annoying gap between the two.

Figure 11:
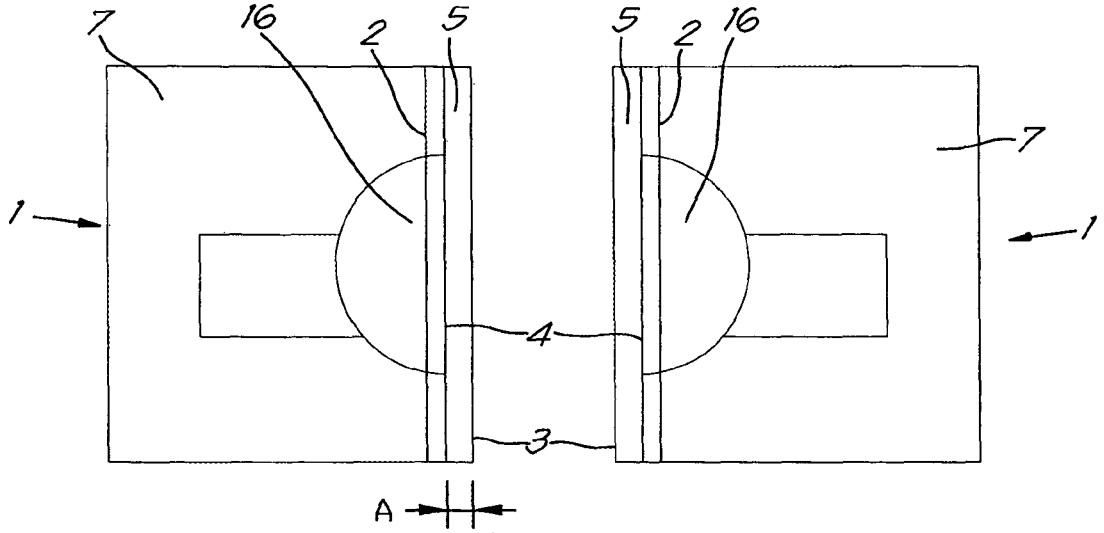
FIG. 11 schematically shows the folded leaves of FIG. 10, but in a detached separated state.

FIG. 11 shows two printed leaves 1, whereby after binding the printing 16 on both leaves 1 will form a whole together. It can clearly be seen in this drawing that the printing 16 only continues up to the second fold line 4.

Figure 12:
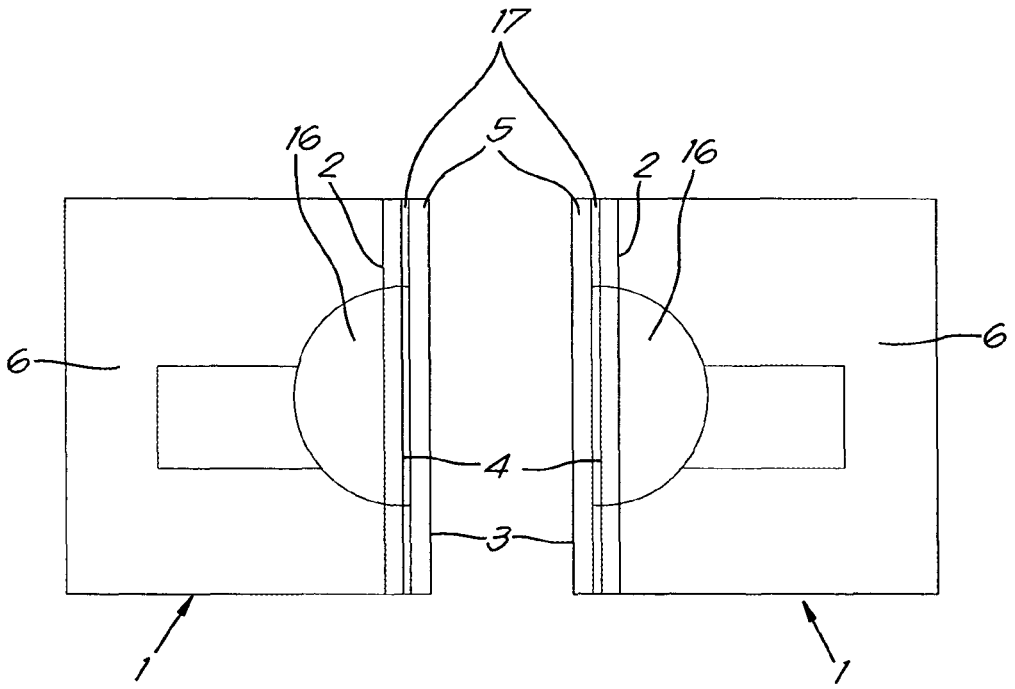
FIG. 12 schematically shows an alternative embodiment of FIG. 11.

FIG. 12 shows a variant of this, whereby a part of the strips 5 are printed with an overlapping part 17 of the printing 16. In other words, the printing 16 runs over or past the second fold line 4.

This overlapping part 17 will disappear with the bound bundle 6 because the leaves 1 lie against one another at the second fold line 4, as shown in FIG. 6.

It is clear that the hotmelt adhesive 11 can be left out and that the bundle 6 can be stapled before being placed in the binding spine 8.

It is also clear that the squeezing of the arms 15 of the U-shaped part 9 of the binding spine 8 can be left out.

Although in the examples shown, all leaves 1 of the bundle 6 present two fold lines 2, 4, it is not excluded that only a proportion of the leaves 1 present two fold lines 2, 4.

The present invention is by no means limited to the embodiments described as an example and shown in the drawings, but a method according to the invention for binding a bundle of leaves and a book or folder thereby obtained can be realised according to different variants without departing from the scope of the invention.

The invention claimed is:

1. A method for binding a bundle (6) of leaves (1), the method comprising the steps of:

folding each leaf (1) of a plurality of leaves (2), each leaf (1) having an edge (3) and a binding strip (5) located at the edge (3), said folding comprises double folding the binding strip (5) of each leaf (1) over a same line to obtain thereby a first fold line (2) that extends parallel to and at a first distance (A) from the edge (3) of each leaf (1) and a second fold line (4) that is located parallel to and at a second distance (B) from said first fold line (2), the second fold line (4) being located intermediate the first fold line (2) and the edge (3) of each leaf (1), the first and second fold lines extending over an entire length of each leaf (1);

after said folding step, forming a bundle (6) of leaves (1) with the edge (3) of each leave aligned with respect to one another; and binding the edge (3) of the bundle (5) of leaves (1), wherein each leaf (1) of the plurality of leaves (2) forming the binding of leaves comprises only two fold lines, namely the first fold line and the second fold line, and wherein the first fold line is formed and then the second fold line (4) is formed by separate folding over of the leaves (1) along the line forming said first and second fold lines (2, 4).

2. The method according to claim 1, wherein the second distance (B) between the first fold line (2) and the second fold line (4) is the same for all leaves (1) of the bundle (6).

3. The method according to claim 1, wherein the second distance (B) between the first fold line (2) and the second fold line (4) is one to four millimetres.

4. The method according to claim 3, wherein the second distance (B) between the first fold line (2) and the second fold line (4) is two to three millimetres.

5. The method according to claim 1, wherein all leaves (1) of the bundle (6) have the second fold line (4) at a same distance (C) from said edge (3).

6. The method according to claim 1, wherein the binding step comprises providing a binding spine (8) and inserting the bundle (6) of leaves (1) in the binding spine (8), and a distance (C) between said edge (3) and the second fold line (4) corresponds to a depth of the binding spine (8).

7. The method according to claim 1, comprising the step of providing the leaves (1) with printing (16) that continues up to said second fold line (4).

8. The method according to claim 1, wherein sides (7) of adjacent leaves (1) oriented towards one another are provided with printing (16) that continue seamlessly over the second fold line (4) of both leaves (1) from one side (7) to the other side (7) wherein a part of the printing (16) is applied on one side (7) up to the second fold line (4) of the leaf (1) concerned and the part of the printing (16) of the other side (7) is applied up to the second fold line (4) of the adjacent leaf (1).

9. The method according to claim 8, wherein the printing (16) on one side (7) and the printing (16) on the other side (7) continues over the second fold line (4) with an overlapping part (17).

10. The method of claim 1, wherein the first fold line (2) and the second fold line (4) are both obtained by the separate prior double folding over of the leaves (1) along the same line forming said fold line (2, 4).

11. The method of claim 1, wherein the first fold line (2) is obtained by the separate prior double folding over of the leaves (1) along the same line forming said fold line (2, 4).

12. The method of claim 1, wherein the second fold line (4) is obtained by the separate prior double folding over of the leaves (1) along the same line forming said fold line (2, 4).

13. The method according to claim 1, wherein the binding step comprises inserting the bundle (6) of leaves (1) into a U-shaped or V-shaped binding spine (8), and wherein the second distance (C) between said edge (3) and the second fold line (4) corresponds to a depth of the binding spine (8).

* * * * *